United States Patent [19]

Gannon

[11] 3,964,572

[45] June 22, 1976

[54] ADJUSTABLE SAFETY LADDER FOR ABOVE-THE-GROUND SWIMMING POOLS

[76] Inventor: Peter F. Gannon, 8301 16½ Mile Road, Sterling Heights, Mich. 48077

[22] Filed: Mar. 3, 1975

[21] Appl. No.: 554,469

Related U.S. Application Data

[63] Continuation-in-part of Ser. No. 399,393, Aug. 15, 1973.

[52] U.S. Cl. ..... 182/86; 182/106; 182/118; 182/228

[51] Int. Cl.[2] ..... E06C 1/39

[58] Field of Search ..... 182/106, 118, 113, 99, 182/93, 228, 97, 85, 86

[56] References Cited

UNITED STATES PATENTS

| | | | |
|---|---|---|---|
| 2,962,112 | 11/1960 | Ramsberger | 182/118 |
| 3,288,248 | 11/1966 | Gurian | 182/118 |
| 3,390,740 | 7/1968 | Brandel | 182/118 |
| 3,428,146 | 2/1969 | Bair | 182/106 |
| 3,586,124 | 6/1971 | Kunzweiler | 182/106 |

*Primary Examiner*—Reinaldo P. Machado

[57] ABSTRACT

A safety ladder for an above-the-ground swimming pool, such ladder being dependent from a platform mounted on top of the pool wall. A stationary ladder section is clamped to the platform on the water side of the pool such as to be adjustable in length for reaching the bottom of the pool. A pivotal and removable ladder portion, attached by means of removable pins to an end of the platform, is disposed on the ground side of the pool wall.

5 Claims, 7 Drawing Figures

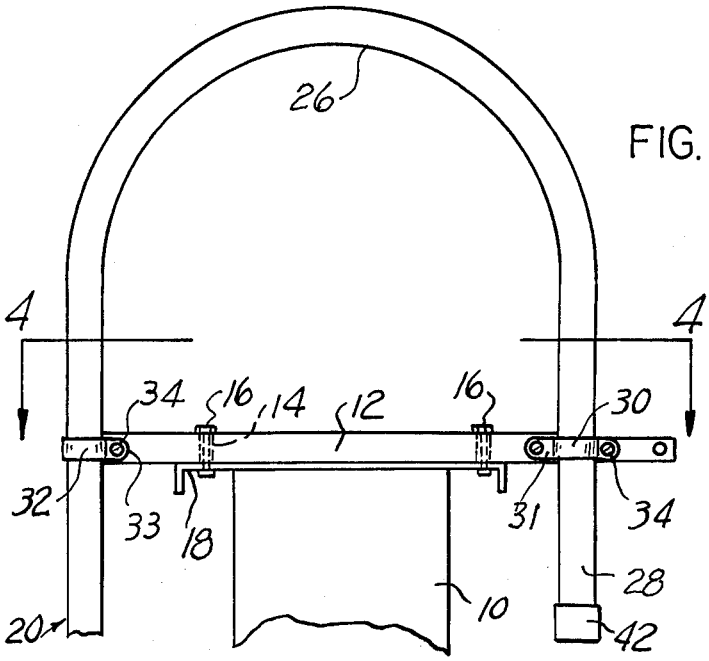
FIG. 3
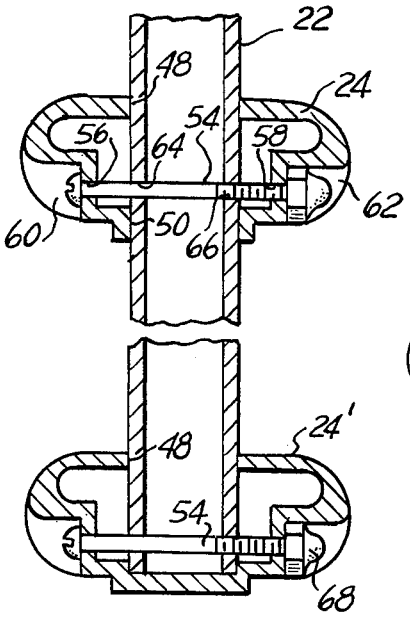
FIG. 7
FIG. 6
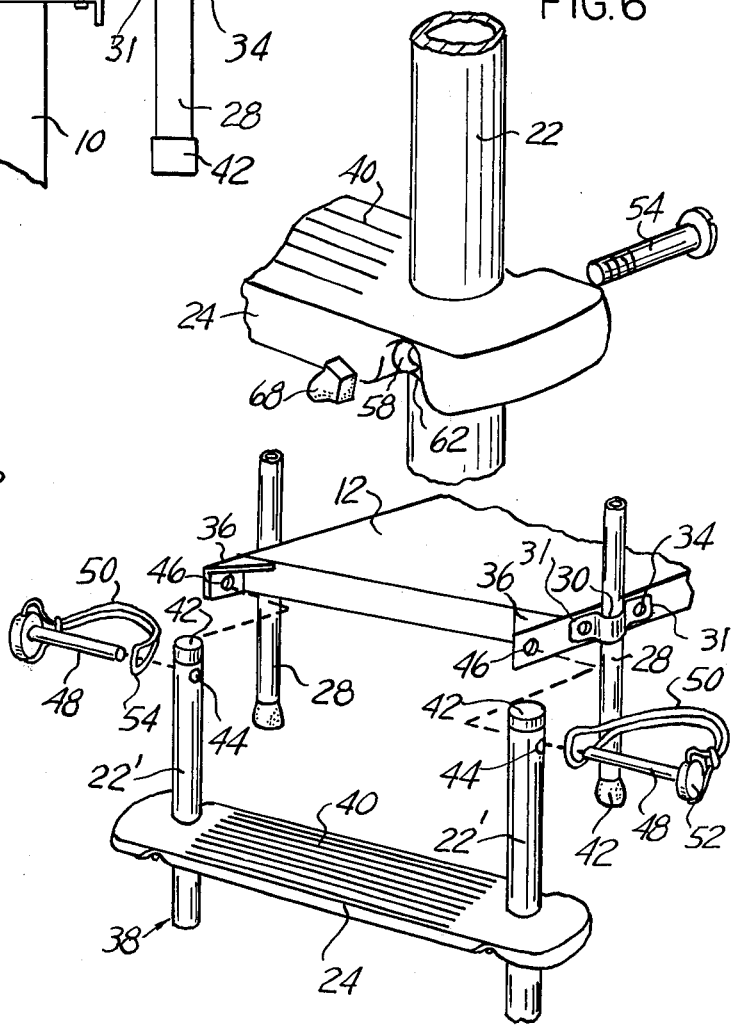
FIG. 5

ADJUSTABLE SAFETY LADDER FOR ABOVE-THE-GROUND SWIMMING POOLS

CROSS REFERENCE TO RELATED APPLICATIONS

The present application is a continuation-in-part of Application Ser. No. 399,393, filed Aug. 15, 1973, and assigned to the same assignee as the present application.

BACKGROUND OF THE INVENTION

The present invention relates to safety ladders for above-the-ground swimming pools and more particularly to a safety ladder having a removable ladder portion disposed on the ground side which is optionally capable of being swung off the ground to prevent unauthorized access to the pool.

It is convenient to provide above-the-ground swimming pools with ladders having a safety feature preventing access to the pools by unauthorized persons, especially small children, from the ground side of the pool wall. Such ladders generally include a section, disposed on the ground side of the pool, which may be retracted, folded, or which may be swung up out of reach of children. However, it has been found that when a pool is left unattended for long periods of time, children desiring to use the pool have discovered many ways for reaching the folded or upswung ladder section and for unfolding or swinging it to its down and accessible position.

The present invention provides a safety ladder with a pivotal ladder section disposed on the ground side of a pool wall, which in addition can be easily removed and stored in a remote location when the pool is not in use.

The prior application, Ser. No. 399,393, referred to herein, discloses several embodiments of safety ladders for above-the-ground pools, each provided ith a pivotal detachable ladder section. The safety ladder of the present invention belongs to the same general classes of safety ladders, but is particularly adapted for permanent, or semi-permanent, fastening to the top of a swimming pool wall, while maintaining the safety feature resulting from being provided with a swingable detachable ladder section disposed on the ground side.

SUMMARY OF THE INVENTION

The object of the present invention is acomplished by providing a safety ladder including a platform portion normally permanently fastened such as to straddle the top of the wall of an above-the-ground swimming pool. A first ladder section is permanently, at least during the swimming season, attached to the platform on the water side of the pool by being affixed to the side of the platform overhanging the water. The means for mounting the the first ladder section provide for height adjustment such that the ladder section may accommodate diverse heights of walls and still reach the bottom of the pool. A pivotal detachable second ladder section is attached by means of removable pins to the side of the platform overhanging the ground.

The many objects and advantages of the present invention will become apparent to those skilled in the art when the following detailed description of the best mode contemplated for practicing the present invention is read in conjunction with the accompanying drawing wherein like reference characters refer to like parts, and in which:

BRIEF DESCRIPTION OF THE DRAWING

FIG. 3 is a partial side elevation view similar to FIG. 2, at an enlarged scale, with the pivotal detachable ladder section omitted;

FIG. 5 is a partial exploded view of the removable pivot means connecting the pivotal detachable ladder section to the platform portion of the ladder of the present invention;

FIG. 6 is an exploded perspective view of the means for securing the steps to the side rails of the safety ladder structure of the present invention; and FIG. 7 is a partial section from line 7—7 of FIG. 1.

DESCRIPTION OF THE PREFERRED EMBODIMENT

Figure 2:
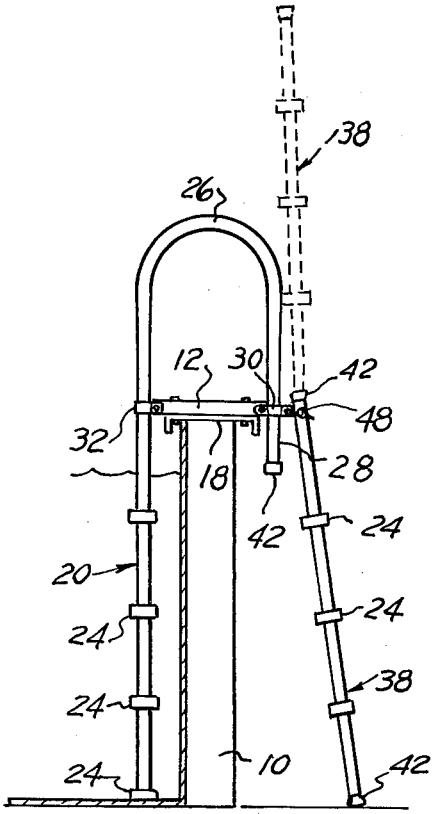
FIG. 2 is a side elevation view of the ladder of FIG. 1 mounted over the wall of an above-the-ground swimming pool.
Figure 1:
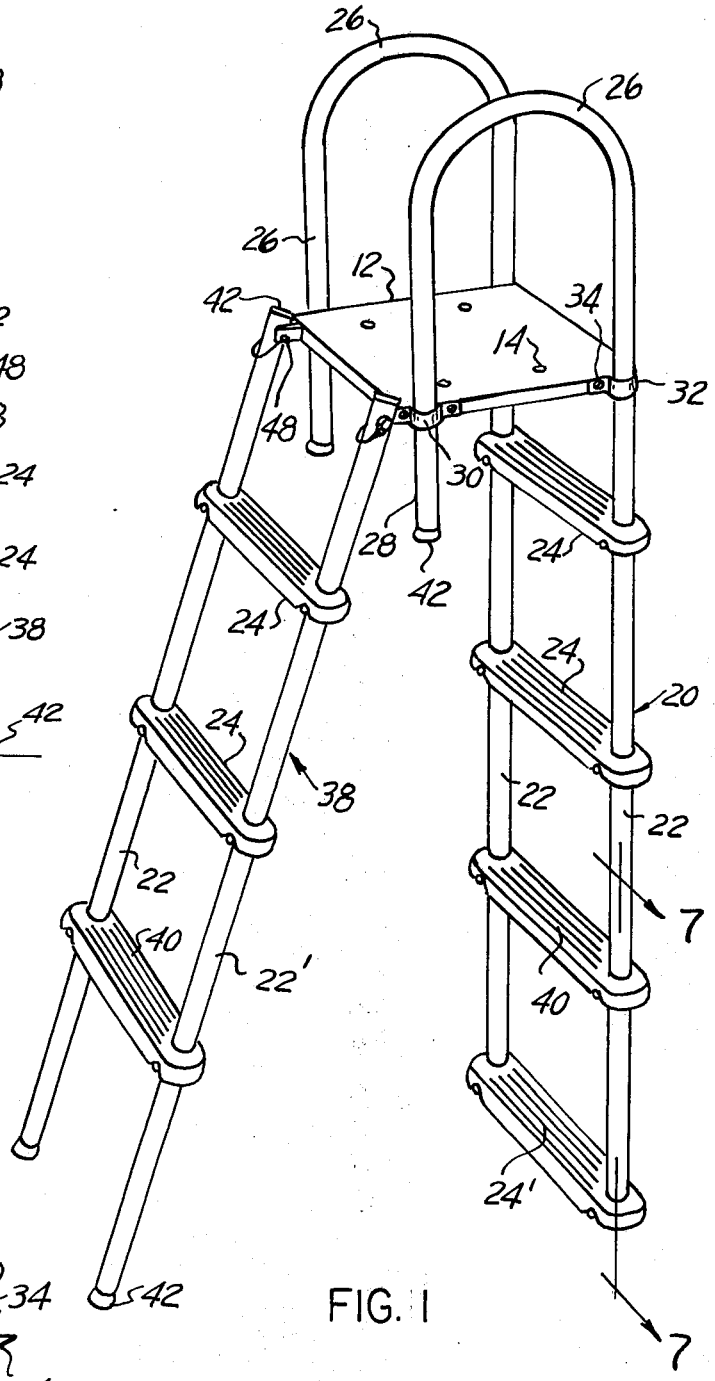
FIG. 1 is a perspective view of a safety ladder according to the present invention.
Figure 4:
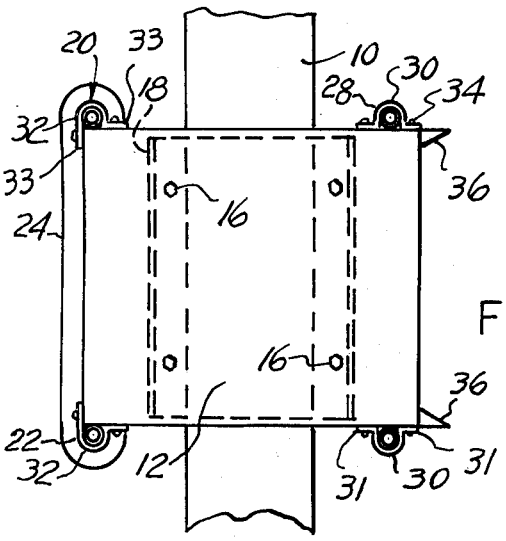
FIG. 4 is a top plan view, partially in section, from line 4—4 of FIG. 3.

Referring now to the drawing, and more particularly to FIGS. 1 and 2 thereof, the safety ladder of the present invention is arranged to be disposed over the sidewall 10, FIG. 2, of an above-the-ground swimming pool. The ladder is made of three principal elements, one of which is in the form of a rectangular platform 12 made of wood, metal, plastic or any appropriate material, preferably provided on its upper face with an appropriate anti-skid finish, and which is normally permanently fastened to the top of the swimming pool wall 10. For that purpose, the platform 12 is provided with appropriate mounting holes 14 through which bolts, such as bolts 16, may be disposed for fastening of the platform to a plate 18, in turn fastened on the top surface of the wall 10 by means such as screws, and the like, not shown.

One edge of the platform 12 overhangs the top of the wall 10 on the water side of the pool wall, and the other edge of the platform overhangs the wall on the ground side. A stationary ladder section 20 is fastened to the platform 12 on the water side. The permanent ladder section 20 consists of a pair of identical parallelly disposed side rail tubular members 22 supporting a plurality of substantially equally spaced steps 24. One end of each of the side rail tubular members 22 is U-shaped, as shown at 26, and comprises a short straight integral end portion 28, substantially parallel to the main portion of the side rail tubular member 22. The permanent ladder portion 20 is fastened to the sides of the platform 12 by means of clips such as clips 30 and 32 held by appropriate fasteners such as screws 34 driven through a mounting hole disposed in each of the integral ear portions 31 and 33 of the clips and threading into the side of the platform 12. The body portion of the clip 30 engages part of the periphery of the short integral straight portion 28 of each side rail member 22, and clamps it against the surface of the side of the platform 12 proximate the end of the platform overhanging the ground. The clip 32 has a body portion surrounding a portion of the peripheral surface of the side rail tubular member 22 between the top step 24 and the bent over U-shaped portion 26 of the side rail tubular member 22, and clamps the tubular member against the surface of the side of the platform overhanging the water when the fastening screws 34 are driven into the side of the platform through the mounting holes of the clip ears 33. It can thus been seen that the ladder structure may accomodate diverse depths of pools, within a given range, and the permanent ladder section 20 may be adjusted in height relative to the platform 12 such that the lower step 24 of the permanent ladder section 20 rests on the bottom of the pool. The U-shaped portion 26 provides a convenient hand grip for anyone utilizing the ladder to climb over the wall 10 of the pool.

As best shown at FIGS. 1 and 5, the end of the platform 12 disposed overhanging on the ground side of the pool is provided with a pair of lateral brackets 36, made integral therewith, or fastened by any convenient means, for pivotally and removably attaching thereto the end of a pivotal and detachable ladder portion 38. The pivotal detachable ladder portion 38 comprises a pair of tubular side rail members 22' supporting a plurality of equidistant steps 24.

Preferably, the side rail tubular members 22', as the side rail members 22 of the permanent ladder portion 20, are made of steel tubings or aluminum tubings of an appropriate gauge for obvious strength and rigidity, and they are preferably provided with an anti-corrosion surface finish. The steps 24 may be made of any convenient material such as wood, aluminum, or the like, but are preferably made of a hollow plastic molding having on its top surface a series of serrations or other anti-skid surface finish, as shown at 40. The ends of the tubings, such as tubings 22' and 22 are provided with an appropriate plug or cap, as shown at 42 to avoid sharp edges.

One end of each of the tubular side rail members 22' has a pair of aligned lateral holes 44 (FIG. 5) for attachment to the platform brackets 36, provided with corresponding apertures 46, a removable pin 48 being adapted to pivotally attach the removable ladder section 38 to the platform 12 by being passed through the aligned mounting holes 44 and 46. The pins 48 are preferably of the type provided with a U-shaped spring retainer 50 pivotally attached to the enlarged head 52 of the pin, the retainer 50 having a loop-like end 54 normally urged in engagement over the end of the pin 48, thus preventing the pin from being accidentally removed from the apertures 44 and 46. When it is desired to remove the removable ladder section 38, the U-shaped spring retainer 50 is manually flatened such that the looped end 54 thereof disengages from the end of the pin 48, enabling the spring retainer 50 to be swung out of the way for manually removing the pin 48. Due to the pivotal coupling provided by the pin assembly of the end of the removable ladder section 38 to the brackets 36, the ladder section 38 may be easily manually swung to a position inaccessible to young children, as shown in dotted line at FIG. 2.

As previously mentioned, the steps 24 are preferably made of hollow plastic moldings, and they are provided proximate their ends with aligned top and bottom apertures 48 and 50, respectively, as best shown at FIG. 7. Preferably, the steps 24 are molded with the aperture 48, but without the aperture 50 which is subsequently punched, or, alternatively, some of the steps in a production run are molded without the aperture 50 which is normally obtained by means of an appropriate removable core disposed in the mold. In this manner, a step devoid of the aperture 50, such as step 24' (FIGS. 1, 2 and 7), may be used as shown fastened at the bottom of the permanent ladder section 20, such as to prevent the bottom end of the tubular side rail members 22', even provided with a plug, from damaging the pool liner. It will be appreciated that the bottom of the removable ladder portion 38 may also be provided with a similar step 24' to prevent the lower end of the side rail tubular membe 22 from digging into soft ground.

The steps 24 are molded with a slight upwardly directed bow, such as to increase the load carrying capacity of the steps. The steps 24 are fastened to the tubular side rail members 22 or 22', as shown at FIGS. 6 and 7, after the side rail members have been passed through the aligned apertures 48 and 50 proximate each end of the steps, by means of appropriate screws or bolts 54 passed through aligned mounting holes 56 and 58, each disposed at the bottom of a recess 60 and 62 formed on the side of the steps 28, axially alignable with transverse lateral holes 64 and 66 drilled along a diameter of the tubular members 22 or 22'. Preferably, the recess 62 has a peripheral shape accepting the flat faces of a square or hexoganol nut 68, threading on the end of the screw or bolt 54, such as to prevent the nut from rotating when the screw or bolt 54 is tightened.

Having thus described the present invention by way of a typical structural embodiment thereof, modifications whereof will be apparent to those skilled in the art, what is claimed as new is as follows:

1. A safety ladder for an above-the-ground swimming pool provided with a peripheral wall forming a separation between a water side and a ground side, said safety ladder comprising a platform; means for fastening said platform on the top of said wall, with a side of said platform projecting on the water side of said pool and an opposite side projecting on the ground side; a pivotal detachable ladder section having a pair of substantially parallel spaced apart side rail members and a plurality of steps fastened intermediate said side rail members; connecting means for pivotally detachably attaching said pivotal detachable ladder section to said platform, said connecting means comprising a pair of brackets permanently attached to said platform on the ground side of said pool, aligned apertures at the end of each of said side members and at the end of each of said brackets, and a pin having a generally U-shaped resilient retainer pivotally attached to one end of said pin and having a loop on its other end adapted to springingly engage and lock onto the other end of said pin; a permanently attached ladder section mounted on said platform and disposed on said water side, said permanently attached ladder section comprising a pair of substantially parallel spaced apart side rail members and a plurality of steps fastened intermediate said side rail members, each of said side rail members having an integral end portion devoid of steps bent over in the form of an inverted U with a rectilinear end section disposed substantially parallel to said side rail members, and means for adjustably fastening said tubular side rail members and the rectilinear end portion thereof proximate the corners of said platform, the inverted U portion of said side rail members projecting above said platform.

2. The safety ladder of claim 1 wherein said means for attaching said permanently mounted ladder section comprises a clip having a body portion in engagement with and surrounding a portion of the periphery of said side rail member and integral ear portions each provided with a mounting hole for the passage therethrough of a mounting screw for attaching said clip to the side of said platform for adjustably clamping said side rail member in position.

3. The safety ladder of claim 1 further comprising a step mounted at the bottom end of at least one of said ladder sections, said step having a continuous bottom surface in engagement with a support surface for said ladder section.

4. The safety ladder of claim 1 wherein said side rail members are tubular.

5. The safety ladder of claim 1 wherein said steps are made of a hollow molding having a pair of aligned apertures at each end thereof for passing therethrough said tubular side rail members for attachment thereto.

* * * * *